US006579097B1

(12) United States Patent
Sampson et al.

(10) Patent No.: US 6,579,097 B1
(45) Date of Patent: Jun. 17, 2003

(54) SYSTEM AND METHOD FOR TRAINING IN MILITARY OPERATIONS IN URBAN TERRAIN

(75) Inventors: Stephen R. Sampson, San Diego, CA (US); Allen E. Ripingill, Jr., San Diego, CA (US)

(73) Assignee: Cubic Defense Systems, Inc., San Diego, CA (US)

( * ) Notice: Subject to any disclaimer, the term of this patent is extended or adjusted under 35 U.S.C. 154(b) by 254 days.

(21) Appl. No.: 09/721,138

(22) Filed: Nov. 22, 2000

(51) Int. Cl.[7] ..... F41G 3/26
(52) U.S. Cl. ..... 434/21; 434/11; 463/5
(58) Field of Search ..... 434/11, 12, 14, 434/16, 365, 19–27; 463/5, 12, 35; 102/355, 427; 342/457; 340/326, 988; 250/208.1; 703/6, 12

(56) References Cited

U.S. PATENT DOCUMENTS 4,545,583 A * 10/1985 Pearman et al. ..... 434/22
4,682,953 A * 7/1987 Doerfel et al. ..... 434/16
4,695,058 A * 9/1987 Carter et al. ..... 434/16
4,752,226 A * 6/1988 Akers et al. ..... 434/11
5,215,464 A * 6/1993 Marshall et al. ..... 250/208.1
5,228,854 A * 7/1993 Eldridge ..... 340/988
5,292,254 A * 3/1994 Miller et al. ..... 102/427
5,426,295 A 6/1995 Parikh et al.
5,454,720 A * 10/1995 FitzGerald et al. ..... 342/457
5,476,385 A 12/1995 Parikh et al.
5,518,401 A 5/1996 FitzGerald et al.
5,556,281 A 9/1996 FitzGerald et al.
5,571,018 A 11/1996 FitzGerald
5,788,500 A * 8/1998 Gerber ..... 102/355
5,823,779 A * 10/1998 Muehle et al. ..... 434/19
6,254,394 B1 * 7/2001 Draper et al. ..... 434/11
6,283,756 B1 * 9/2001 Danckwerth et al. ..... 434/11
6,386,879 B1 * 5/2002 Varshneya et al. ..... 434/16
6,450,817 B1 * 9/2002 Deinlein ..... 102/427

* cited by examiner

*Primary Examiner*—Joe H. Cheng
(74) *Attorney, Agent, or Firm*—Michael H. Jester

(57) ABSTRACT

A stationary area weapon effects simulator is mounted to the ceiling of a room in a building being assaulted by soldiers equipped with optical detectors and small arms weapons having small arms transmitters (SATs). Area effects weapon codes simulating the detonation of a grenade, bomb, artillery shell or chemical/biological weapon are encoded onto infrared signals emitted by a plurality of LEDs in the weapon effects simulator and these codes are logged in player units (DPCUs) carried by the soldiers. The simulated area weapon effects may be confined to particular angular zones and this zone information may also be encoded onto the infrared emissions. An alternate embodiment utilizes a stationary locator in a room which only emits infrared signals with location information encoded in the same which are logged by the player unit. Area weapon effects and location information may be downloaded from the player units, along with conventional casualty, near miss and time of occurrence data for assessment of tactics and weapons usage accuracy during after action review (AAR) by an instructor. A red rotating beacon may be added to the area weapon effects simulator to indicate the simulated detonation and/or to indicate that a structure such as a bridge has been blown up and can no longer be used. The area weapon effects simulator can be activated by sending an RF command received through a pager, or by manual devices such as an electro-mechanical switch connected to a trip wire.

25 Claims, 3 Drawing Sheets

SYSTEM AND METHOD FOR TRAINING IN MILITARY OPERATIONS IN URBAN TERRAIN

BACKGROUND OF THE INVENTION

The history of modern warfare is full of examples of heavy casualties being incurred when soldiers attempt to overtake a well defended city on foot. The World War II battle of Stalingrad involved door to door fighting of ground troops for many weeks. Effective usage of tanks, artillery, and air power by the attackers is greatly impeded because the defenders hunker down in basements and employ snipers to great advantage. In the post-cold war era, the U.S. military is expected to face many engagements with hostiles in urban settings. It is increasingly necessary for a small number of lightly armed soldiers to enter one or more buildings defended by armed terrorists and other hostiles and to eliminate these hostiles, rescue hostages and secure the area from counter-attack. In many cases unarmed civilians are also present and they must not be harmed if at all possible. The presence of civilians makes it politically unacceptable to use bombs and other heavy weapons under such circumstances. The presence of civilians or so-called friendlies also impedes traditional methods of infantry attack. The U.S. Army in particular has placed a very high emphasis in effective training soldiers in optimum doctrine, tactics and weapons usage in "military operations in urban terrain" (MOUT). Therefore, it is necessary for soldiers to receive rigorous training in environments that simulate real-life urban combat conditions as closely as possible. Special weapons and tactics (SWAT) teams of local law enforcement agencies can also benefit from similar training.

For many years the U.S. Army has trained soldiers with a multiple integrated laser engagement system (MILES). One aspect of MILES involves a small arms laser transmitter (SAT) being affixed to the barrel of a small arms weapon such as an M16A1 rifle or a machine gun. Each soldier is fitted with optical detectors on his or her helmet and on a body harness adapted to detect an infrared laser "bullet" hit. The soldier pulls the trigger of his or her weapon to fire a blank or blanks to simulate the firing of an actual round or multiple rounds. An audio sensor and a photo-optic sensor in the SAT detect the firing of the blank round(s) and simultaneously a semiconductor laser diode in the SAT is energized to emit an infrared laser beam toward the target in the conventional sights of the weapon. The infrared laser beam is encoded with the soldier's player identification (PID) code. Each soldier wears a digital player control unit (DPCU) that tells the player whether he or she has suffered a particular type of casualty or had a near miss, the time of the event and the identity of the shooter.

The U.S. Army presently uses MILES equipment in its MOUT training. MILES-equipped soldiers conduct orchestrated assaults on buildings defended by MILES-equipped enemies. During so-called after action reviews (AARs) instructors can download information from each player control unit to assess whether or not the soldiers have followed proper tactics and the accuracy of their small arms weapons fire. Critical to instructor assessment of assault team performance is the location of each player within the building at a given time of the exercise. This information is presently not available in conventional MILES equipment used indoors.

It is difficult to track the movements of military commandos during simulated urban assaults because they often take place in complete darkness thus requiring the use of infrared night vision devices. Therefore, it is not possible simply to use video surveillance. Infrared tracking is not a viable option because it requires mirrors and other delicate devices not well suited for harsh training environments. Furthermore, infrared tracking could interfere with the operation of the conventional MILES training equipment. A radar-based locating system would not be appropriate for simulated urban training environments because of the distortions induced by the building structures such as steel door frames that would impair location accuracy. Ultrasound position locating systems have so-far proven to be problematic in this type of environment because the firing of blank cartridges and other spurious sources of ultra-sound noise interfere with the precisely timed ultrasound signals from pre-positioned emitters. Global positioning system (GPS) equipment cannot acquire satellite signals indoors.

During a MOUT training exercise utilizing conventional MILES training equipment it is not possible to simulate area weapon effects, e.g the detonation of a hand grenade, bomb, artillery shell or chemical biological weapon. While these types of area weapon effects can be simulated in a complex area weapon effects system (AWES), such a system requires the use of GPS, multilateration or some other type of sophisticated and expensive position locating system not suitable for use inside buildings.

Any addition of location and area weapon effects features to conventional MILES training equipment must should be done as inexpensively as possible to provide the U.S. military and its allies with the option of performing "home station" MOUT training without having to travel to sophisticated, highly instrumented national training ranges such as the one located in Barstow, Calif. In addition, any additional equipment should be readily installed and should not require major physical alterations to the site. This is because it would be desirable to hastily construct and instrument a building or set of buildings that closely resembles an actual crisis location and to conduct "dress rehearsal" MILES-based MOUT training therein with location detection and area weapon effects features. For example, a make-shift Entebbe airport terminal could have been constructed, instrumented and used for assault training by the Israeli special forces before conducting the actual rescue operation. It would be unduly expensive to wire mock buildings and install video cameras throughout the same. In some cases, it may not be possible to make physical alterations to a structure, such as the passenger cabin of a commercial airliner, for the purpose of instrumenting the same for a MILES-based MOUT exercise.

SUMMARY OF THE INVENTION

It is therefore the primary object of the present invention to provide a low cost system and method that will provide indications to instructors of the location of each member of an assault team during a MOUT training exercise utilizing conventional MILES equipment.

It is another object of the present invention to provide a low cost system and method that will enable area weapon effects to be simulated during a MOUT training exercise utilizing conventional MILES equipment.

It is still another object of the present invention to provide a system and method that will allow buildings and other facilities to be rapidly equipped for MILES-based MOUT training exercises that permit location tracking and area weapon effects simulation, without making any major physical modifications to the facilities.

In accordance with one embodiment of the present invention, a system is provided for training players in an urban combat environment. The system includes at least one stationary area effects weapon simulator including a first infrared emitter. A plurality of sets of infrared detectors are also provided, each set being worn by a player. A plurality of player units are also provided, each player unit being carried by a player and connected to a corresponding set of infrared detectors for logging hits on the corresponding set of detectors of infrared energy emitted from the first infrared emitter in the stationary area effects weapon simulator or a second infrared emitter mounted on a mobile small arms weapon. In an alternate embodiment of the system, instead of the stationary area effects weapon simulator, a stationary locator is used which transmits a location signal encoded in an infrared emission which is logged by the player units so that an instructor can determine when and where the player suffered a casualty or a near miss.

The present invention also provides a method of training players in an urban combat environment. The method involves the initial step of equipping a plurality of players with optical detectors, SAT-equipped small arms weapons, and player units. The method further involves installing a stationary area effects weapon simulator in a room of a building or other combat area to be assaulted by the players. The method further involves the steps of causing the players to enter the combat area and emitting infrared energy from the stationary area effects weapon simulator at an optical wavelength compatible with the optical wavelength of the energy emitted by the SAT-equipped small arms weapons. The infrared energy emitted from the stationary area effects weapon simulator has a weapon effects code and/or a location code encoded therein. The next step of the method involves receiving the infrared energy emitted from the stationary area effects weapon simulator with the optical detectors of at least one of the players that has entered the combat area. The final step of our method involves logging the weapon effects and location codes in the player unit of the player that has received the infrared energy emitted from the stationary area effects weapon simulator. In a modification of the method, only a location code is emitted by a stationary locator which is logged by the player unit.

DESCRIPTION OF THE PREFERRED EMBODIMENTS

Figure 1:
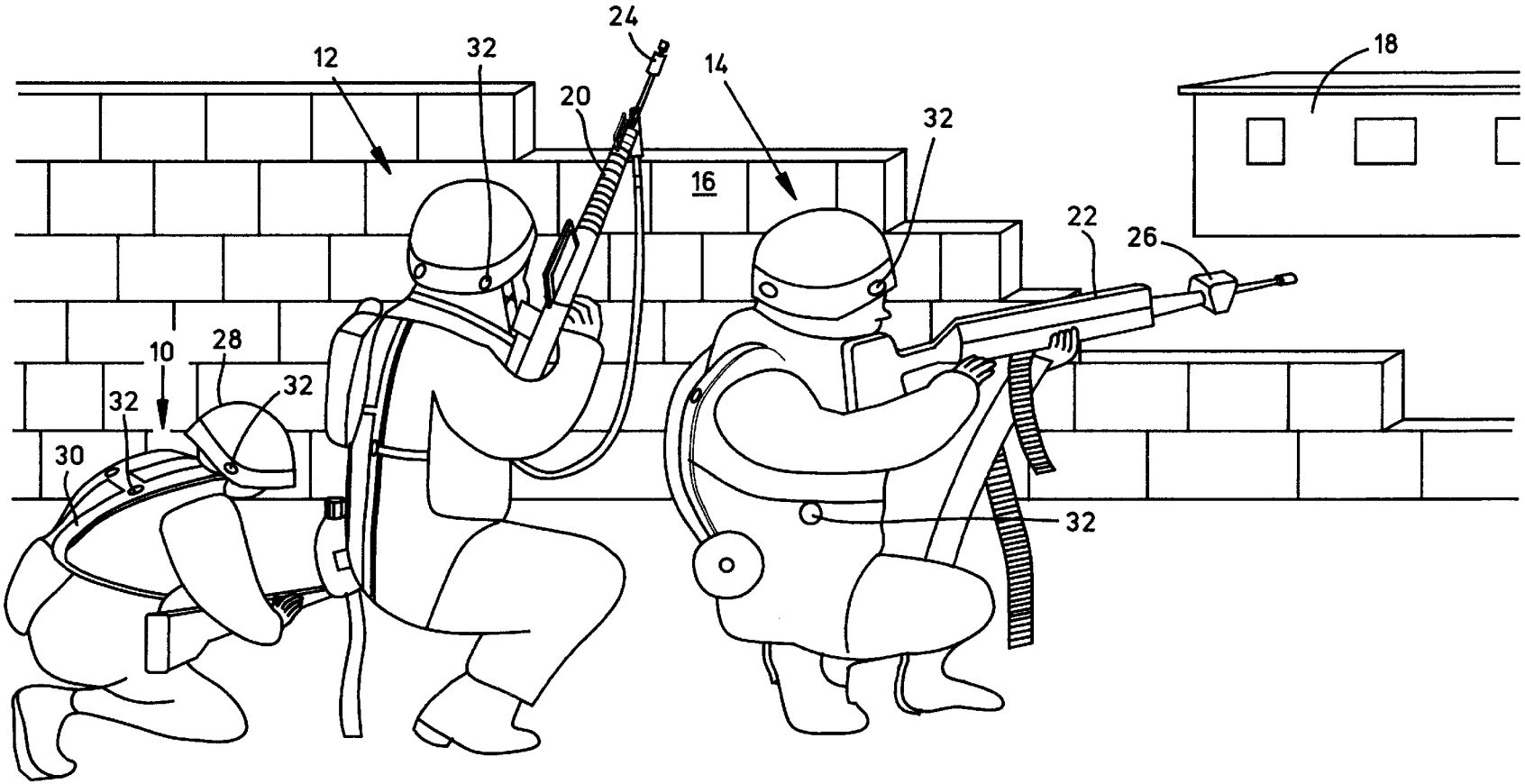
FIG. 1 is an illustration of three lightly armed SAT-equipped soldiers taking cover behind a block wall and assaulting a building sheltering armed hostiles a short distance away during a MOUT training exercise.

FIG. 1 illustrates three lightly armed soldiers 10, 12 and 14 taking cover behind a block wall 16 and assaulting a building 18 sheltering armed hostiles a short distance away. The soldiers 12 and 14 are shown holding small arms weapons 20 and 22 each equipped with MILES SATs 24 and 26, respectively. The weapon 20 is an M16A2 assault rifle and the weapon 22 is an M249 squad automatic weapon. While a portion of a military commando unit has been illustrated in FIG. 1, it should be understood that police officers and other law enforcement personnel could utilize the system and method disclosed herein. Different types of armed personnel are generically referred to herein as "players."

Each of the soldiers, such as soldier 10, wears a helmet 28 and an H-shaped vest 30 equipped with sets of disk-shaped optical infrared detectors 32 that detect infrared radiation that impinges thereon representing a MILES casualty or near miss fired by the SAT of a hostile hold up inside the building 18. The casualty could be a kill or an injury of a predetermined severity that could impede mobility, for example. The infrared radiation is preferably emitted by semiconductor laser diodes inside the SATs at an optical wavelength of approximately nine hundred and four nanometers. By way of example, the SATs 24 and 26 may be constructed in accordance with the SAT disclosed in U.S. Pat. No. 5,476,385, issued Dec. 19, 1995 and entitled "Laser Small Arms Transmitter", the entire disclosure of which is incorporated herein by reference. Each soldier carries a player unit 34 (FIG. 2) which is connected to the infrared detectors 32 (FIG. 1) and logs MILES events into its memory according to the time they occurred such as a casualty and a near miss, along with the shooter's identity (PID code) which is encoded on the infrared laser beam of the shooter's SAT. By way of example, the player units may be constructed in accordance with the player unit disclosed in U.S. Pat. No. 5,426,295, issued Jun. 20, 1995 and entitled "Multiple Integrated Laser Engagement System Employing Fiber Optic Detection Signal Transmission", the entire disclosure of which is hereby incorporated herein by reference. A conventional MILES player unit is referred to as a digital player control unit (DPCU). The aforementioned U.S. Pat. Nos. 5,476,385 and 5,426,295 are assigned to Cubic Defense Systems, Inc., the assignee of the subject application.

Figure 2:
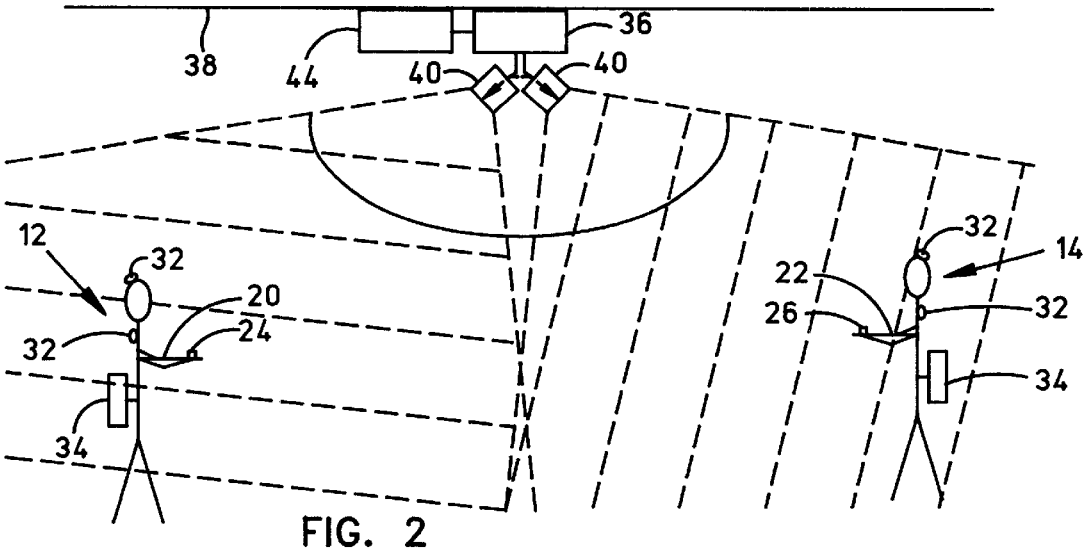
FIG. 2 is a diagrammatic illustration of a side view of two soldiers in different kill zones of a stationary area effects weapon simulator attached to the ceiling of a room in accordance with a first embodiment of the present invention.
Figure 3:
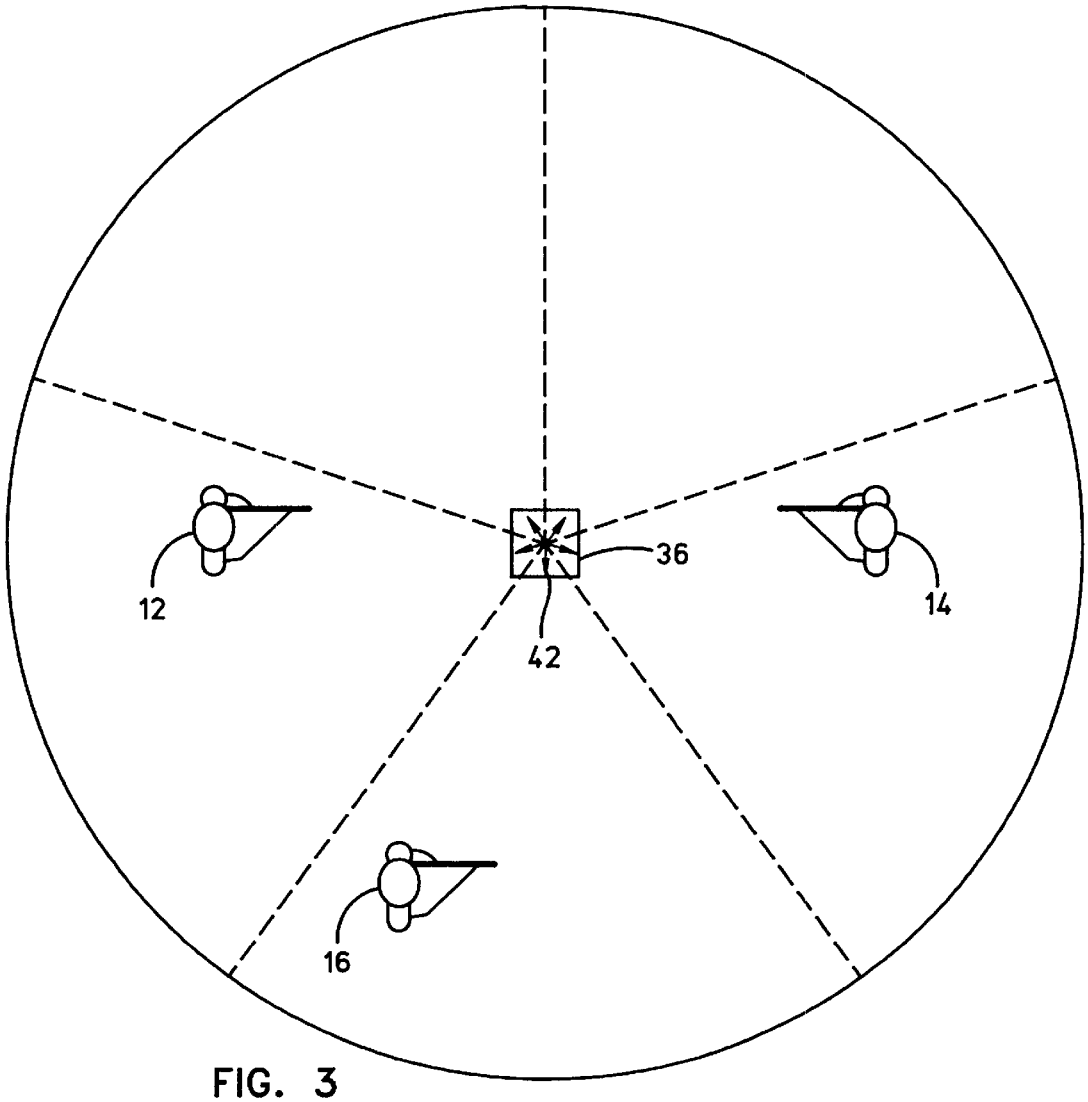
FIG. 3 is a diagrammatic illustration of a top plan view of three soldiers in different kill zones of a stationary area effects weapon simulator attached to the ceiling of a room in accordance with the first embodiment of the present invention.

Referring to FIGS. 2 and 3, in accordance with the present invention a stationary area effects weapon simulator 36 is secured to the ceiling 38 of a room inside the building 18 which has been entered by the soldiers 12 and 14. The simulator 36 includes five infrared LEDs 40 that are spaced in a circumferential array to provide a substantially omnidirectional pattern of emissions. The infrared emissions from each of the LEDs 40 in the preferred embodiment of the simulator 36 are confined to five corresponding kill zone sectors by an optical divider 42 (FIG. 3). The optical divider 42 may be inexpensively made up of five radially extending walls that separate the individual LEDs 40. The optical divider 42 is not illustrated in FIG. 2. Of course the infrared emissions could be confined to more or less zones, as desired.

The system of the present invention implements area effects weapon simulators and can provide not only room location, but zone location as well. Thus all players can be localized, e.g. their player units (DPCUs) time tag their entry into certain rooms and zones within the room. The stationary area effects weapon simulator 36 could also be placed outdoors on the ground, on a structure such as a bridge or in another location. Collectively these indoor and outdoor environments, which can be illuminated in zones, are referred to herein as "combat areas." All players entering an activated zone will receive via their optical detectors an encoded infrared signal that simulates the detonation of an area effects weapon such as a hand grenade, bomb, artillery shell or chemical/biological weapon. The typical kill range would have a radius of sixteen to twenty-five feet from the stationary area effects weapon simulator 36. The time and identification code of the type of area weapons are logged by the receiving soldier's player unit 34 and its effect can be indicated to the player at that time through visual displays or audio alarms and assessed in a subsequent AAR. A conventional MILES DPCU can record a zone identification number as a PID code using an unused weapon/near miss code, along with a time tag. This information is stored in the memory of the MILES DPCU along with other MILES events.

When the stationary area effects weapon simulator 36 is activated it "kills" or "injures" every player in the illuminated zone or zones. These zones may be simultaneously illuminated or selectively illuminated and the infrared emissions in each zone may have a unique PID code encoded therein so that the AAR can assess the exact location of the soldier when killed. The energized LEDs 40 in the stationary area effects weapon simulator 36 can transmit so-called kill words or weapon effects codes for a predetermined time interval. Along with the kill words, the zone PID code can also be sent. Typically a pulse modulation encoding scheme is conveniently utilized. Particular zones may be illuminated to simulate the placement of certain area effects weapons within a room or to simulate the sector confined effects of certain area effects weapons.

In an alternate embodiment of the present invention, the array of LEDs 40 mounted to the ceiling 38, along with their drive circuitry, only transmits room and/or zone PID codes to provide each player unit 34 with location information, but not simulated area weapon effects. In this case, the LEDs 40 and their associated circuitry act as a locator instead of a stationary area effects weapon simulator. This location data can be assessed by an instructor in the AAR to determine where a player was located within the building 18 or other combat area when he or she suffered a casualty or near miss from an enemy SAT.

Figure 4:
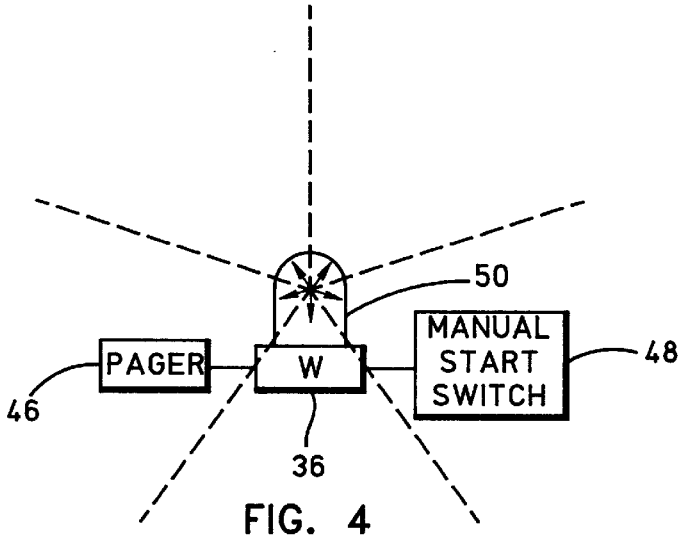
FIG. 4 is a diagrammatic illustration of a second embodiment of the present invention that includes a red rotating beacon that tells players that a area effects weapon simulator has been detonated and/or that a structure to which the beacon is attached has been blown up and is out of service.

Referring again to FIG. 2, the stationary area effects weapon simulator 36 can be activated by an activator 44 which can be a conventional RF receiver such as a pager or a manual device such as a toggle switch or a trip wire activated electro-mechanical switch, for example. Both types of activators could be used together providing alternative means of activation as shown in FIG. 4 where an RF pager 46 and a manual start switch 48 are connected to the stationary area effects weapon simulator 36. Visual indication means in the form of a luminous rotating red beacon 50 (FIG. 4) can be attached to the stationary area effects weapon simulator 36. The beacon 50 is illuminated when the stationary area effects weapon simulator 36 is activated so that the soldiers immediately know that they have been "killed" or "injured." This also allows the device to be mounted on a bridge or other structure or vehicle to indicate to players that it is out of service. For example, where the LEDs 40, activator 44 and beacon 50 are mounted on a bridge, an RF command signal could be sent by the instructor to the activator 44 when the same is an RF pager. This command signal would cause the beacon 50 to be illuminated and the LEDs 40 to emit kill signals simulating the explosion of a bomb or an artillery shell. Players close to the bridge would be "killed" or "injured" and the rotating red beacon 50 would tell players subsequently arriving at the bridge that the bridge has been blown up and cannot be crossed.

Figure 5:
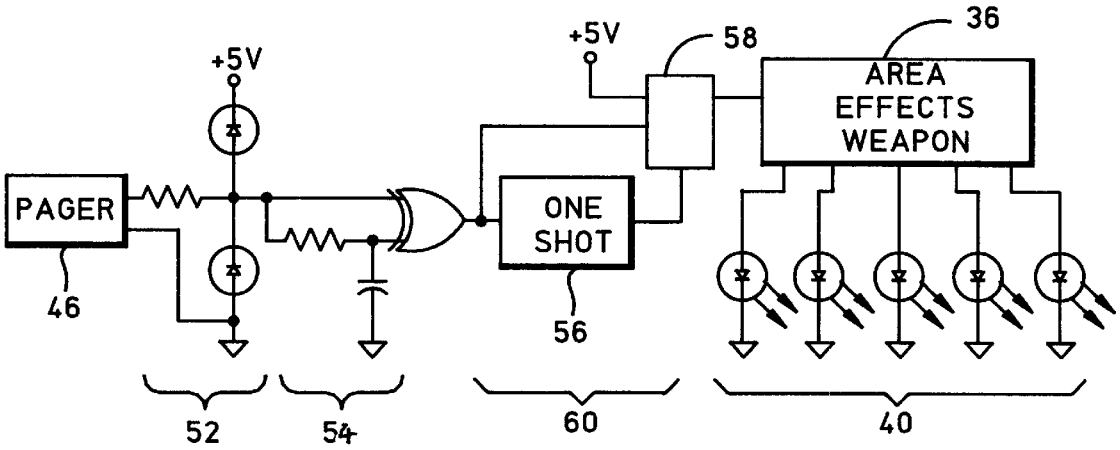
FIG. 5 is a schematic diagram of the first embodiment.

FIG. 5 is a schematic diagram of the individual location and kill embodiment of the present invention. The pager 46 is connected through input protection and edge detection circuits, 52 and 54, respectively, to a five second one-shot device 56 and an integrated circuit 58 that function as a triggering circuit 60. When the appropriate RF command is sent by the instructor and received by the pager 46, the stationary area effects weapon simulator 36 energizes one or more of the infrared LEDs 40 with the appropriate location and kill codes. The circuit of FIG. 5 could also incorporate the manual input switch 48 illustrated in FIG. 6.

Figure 6:
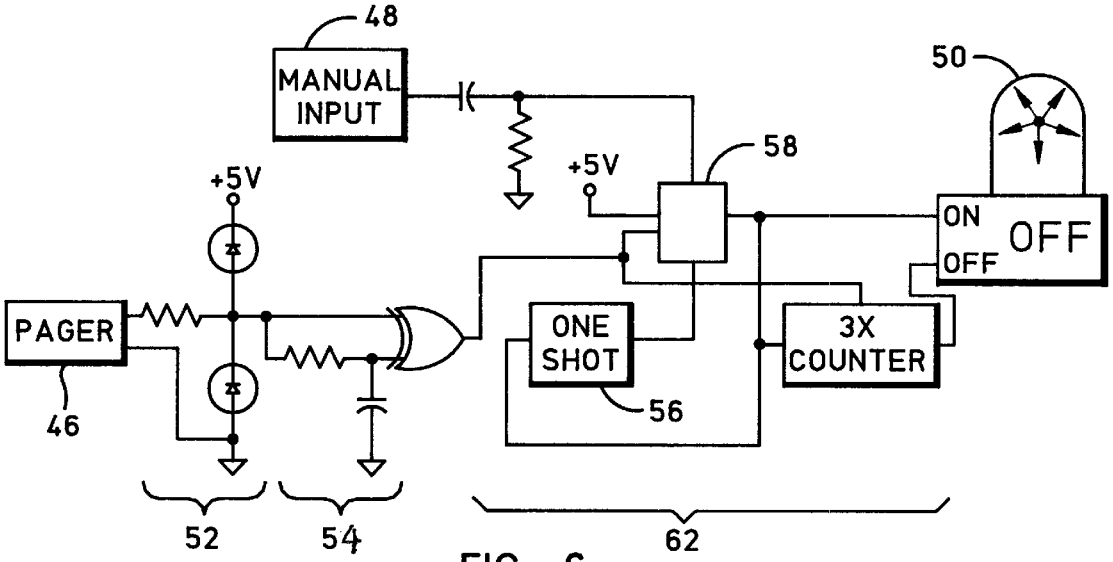
FIG. 6 is a schematic diagram of the second embodiment.

FIG. 6. is a schematic diagram of the out-of-function embodiment of the present invention. Either the pager 46 or the manual input switch 48 activate the beacon 50 through a triggering circuit 62 including one shot 56, a three times counter 64 and integrated circuit 58. The device of FIG. 6 can be de-activated by sending three consecutive commands to the pager 46 within a specified time interval.

The devices illustrated schematically in FIGS. 5 and 6 can be battery powered and made relatively small in size. They can also be powered via low voltage wiring in semi-permanent installations. The devices illustrated in FIGS. 5 and 6 can be enclosed in low profile, round plastic housings of six inches in diameter and one and one-half inches in height, similar in configuration to the housing of a domestic smoke detector. The rotating beacon 50 of the FIG. 6 device can also be less than six inches in diameter and height. The devices of FIGS. 4 and 5 are very inexpensive to manufacture. They can be readily installed and anchored with adhesive, VELCRO® straps or screws.

It will be appreciated that we have also provided a method of training players in an urban combat environment. Our method involves equipping a plurality of players 12 and 14 with optical detectors 32, SAT-equipped small arms weapons 20 and 22 and player units 34. Our method further involves installing a stationary area effects weapon simulator 36 in a room of a building 18 or other combat area to be assaulted by the players. Our method further involves the steps of causing the players 12 and 14 to enter the combat area and emitting infrared energy from the stationary area effects weapon simulator 36 at an optical wavelength compatible with the optical wavelength of energy emitted by the SAT-equipped small arms weapons. The infrared energy emitted from the stationary area effects weapon simulator 36 has a weapon effects code and/or a location code encoded therein. The next step of our method involves receiving the infrared energy emitted from the stationary area effects weapon simulator 36 with the optical detectors of at least one of the players 12 or 14 that have entered the combat area. The final step of our method involves logging the weapon effects and location codes in the player unit 34 of the player 12 or 14 that has received the infrared energy emitted from the stationary area effects weapon simulator 36. In a modification of the method, only a location code is emitted by a stationary locator which is logged by the player unit.

While we have described various embodiments of our invention, modifications of the same will occur to those skilled in the art. Therefore, the protection afforded our invention should only be limited in accordance with the scope of the following claims.

We claim:

1. A system for training players in an urban combat environment, comprising:

at least one stationary area effects weapon simulator including a first infrared emitter;

a plurality of sets of infrared detectors, each set being worn by a player; and a plurality of player units, each player unit being carried by a player and connected to a corresponding set of infrared detectors for logging hits on the corresponding set of detectors of infrared energy emitted from the first infrared emitter in the stationary area effects weapon simulator or a second infrared emitter mounted on a mobile small arms weapon.

2. The system of claim 1 and further comprising an RF transceiver for receiving an RF command for activating the stationary area effects weapon simulator.

3. The system of claim 1 wherein each player unit includes means for logging a plurality of events according to time of occurrence, the events being selected from the group consisting of a casualty, a near miss, and an area effects weapon detonation.

4. The system of claim 1 wherein the stationary area effects weapon simulator includes means for encoding an infrared emission therefrom with a room location code.

5. The system of claim 1 wherein the stationary area effects weapon simulator includes means for manually activating the stationary area effects weapon.

6. The system of claim 1 wherein the stationary area effects weapon simulator includes means for dividing the energy emitted by the first infrared emitter to generate a plurality of kill zones.

7. The system of claim 1 wherein the stationary area effects weapon simulator includes means for providing a visual indication that it has been activated.

8. The system of claim 7 wherein the visual indication means is a luminous beacon.

9. The system of claim 1 wherein the first emitter comprises an infrared LED.

10. The system of claim 1 wherein the stationary area effects weapon simulator includes a plurality of first infrared emitters arranged to provide a substantially omnidirectional pattern of emissions.

11. A system for training players in an urban combat environment, comprising:

a stationary locator including a first infrared emitter and means for encoding an infrared emission therefrom with a location code;

a plurality of sets of infrared detectors, each set being worn by a player; and a plurality of player units, each player unit being carried by a player and connected to a corresponding set of infrared detectors for logging hits on the corresponding set of detectors of infrared energy emitted from the first infrared emitter in the locator or a second infrared emitter mounted on a mobile small arms weapon.

12. The system of claim 11 and further comprising an RF receiver for receiving an RF command for activating the locator.

13. The system of claim 11 wherein each player unit includes means for logging events according to time of occurrence.

14. The system of claim 11 wherein the locator includes means for manually activating the locator.

15. The system of claim 11 wherein the locator includes means for providing a visual indication that it has been activated.

16. The system of claim 15 wherein the visual indication means is a luminous beacon.

17. The system of claim 11 wherein the first infrared emitter comprises an infrared LED.

18. The system of claim 11 wherein the locator includes a plurality of first infrared emitters arrange to provide a substantially omnidirectional pattern of emissions.

19. The system of claim 11 wherein the locator includes means for generating an infrared emission that simulates an area effects weapon detonation.

20. The system of claim 11 wherein each player unit includes means for logging a plurality of events according to time and location of occurrence, the events being selected from the group consisting of a casualty, a near miss, and an a simulated area effects weapon detonation.

21. A method of training players in an urban combat environment, comprising the steps of:

equipping a plurality of players with optical detectors, SAT-equipped small arms weapons and player units;

installing a stationary area effects weapon simulator in a combat area;

causing the players to enter the combat area;

emitting infrared energy from the stationary area effects weapon simulator at an optical wavelength compatible with an optical wavelength of energy emitted by the SAT-equipped small arms weapons, the infrared energy emitted from the stationary area effects weapon simulator having a weapon effects code encoded therein;

receiving the infrared energy emitted from the stationary area effects weapon simulator with the optical detectors of at least one of the players that has entered the combat area; and logging the weapon effects code in the player unit of the player that has received the infrared energy emitted from the stationary area effects weapon simulator.

22. The method of claim 21 and further comprising the steps of encoding a location code in the infrared energy emitted from the stationary area effects weapon simulator and logging the location code in the player unit of the player that has received the infrared energy emitted from the stationary area effects weapon simulator.

23. The method of claim 21 and further comprising the steps of encoding a simulated area effects weapon code in the infrared energy emitted from the locator and logging the weapon code in the player unit of the player that has received the infrared energy emitted from the locator.

24. A method of training players in an urban combat environment, comprising the steps of:

equipping a plurality of players with optical detectors, SAT-equipped small arms weapons and player units;

installing a locator in a combat area;

causing the players to enter the combat area;

emitting infrared energy from the locator at an optical wavelength compatible with an optical wavelength of energy emitted by the SAT-equipped small arms weapons, the infrared energy emitted from the locator having a location code encoded therein;

receiving the infrared energy emitted from the locator with the optical detectors of at least one of the players that has entered the combat area; and logging the location code in the player unit of the player that has received the infrared energy emitted from the locator.

25. A method of training players in an urban combat environment, comprising the steps of:

equipping a plurality of players with optical detectors, SAT-equipped small arms weapons and player units;

installing a stationary area effects weapon simulator in a combat area;

causing the players to enter the combat area;

emitting infrared energy from the stationary area effects weapon simulator at an optical wavelength compatible with an optical wavelength of energy emitted by the SAT-equipped small arms weapons, the infrared energy emitted from the stationary area effects weapon simulator having a weapon effects code and a location code encoded therein;

receiving the infrared energy emitted from the stationary area effects weapon simulator with the optical detectors of at least one of the players that has entered the combat area; and logging the weapon effects and location codes in the player unit of the player that has received the infrared energy emitted from the stationary area effects weapon simulator.

* * * * *